United States Patent [19]

Fremery et al.

[11] 4,080,436

[45] Mar. 21, 1978

[54] THERMOELECTROCHEMICAL CYCLICAL PROCESS FOR PRODUCTION OF HYDROGEN AND OXYGEN FROM WATER

[75] Inventors: Max Fremery, Wesseling; Hans-Rolf Buhmann, Langenfeld, both of Germany

[73] Assignee: Rheinische Braunkohlenwerke AG, Cologne, Germany

[21] Appl. No.: 785,243

[22] Filed: Apr. 6, 1977

[30] Foreign Application Priority Data

Apr. 8, 1976 Germany ..... 2615302

[51] Int. Cl.[2] ..... C01B 13/02; C01B 1/02

[52] U.S. Cl. ..... 423/579; 204/129; 423/648 R

[58] Field of Search ..... 423/579, 648; 204/103, 204/128, 129

[56] References Cited

U.S. PATENT DOCUMENTS

| | | | |
|---|---|---|---|
| 3,888,750 | 6/1975 | Brecher | 423/579 X |
| 3,932,599 | 1/1976 | Schulten et al. | 423/579 X |

FOREIGN PATENT DOCUMENTS

| | | | |
|---|---|---|---|
| 2,516,441 | 10/1975 | Germany | 423/648 |

OTHER PUBLICATIONS

"A Hydrogen-Energy System", copyright American Gas Association, 1973, pp. III-42 to III-68.

"Hydrogen Sought via Thermochemical Methods", C & EN, Sept. 3, 1973, pp. 32 and 33.

Pangborn et al. "Hydrogen Energy Theme Conference 1974" pp. 499-515.

*Primary Examiner*—Edward J. Meros

*Attorney, Agent, or Firm*—Connolly and Hutz

[57] ABSTRACT

A process for producing hydrogen and oxygen from water in a cyclical process wherein aqueous sulfuric acid, containing hydrogen bromide, is electrolyzed to form hydrogen and bromine. Bromine is reacted with sulfur dioxide and water into sulfuric acid and hydrogen bromide. The hydrogen bromide is separated from the sulfuric acid and recycled into the electrolysis. The sulfuric acid is thermally cracked to form sulfur dioxide, water and oxygen. Sulfur dioxide is recycled and combined with bromine for completion of the reaction cycle.

7 Claims, 1 Drawing Figure

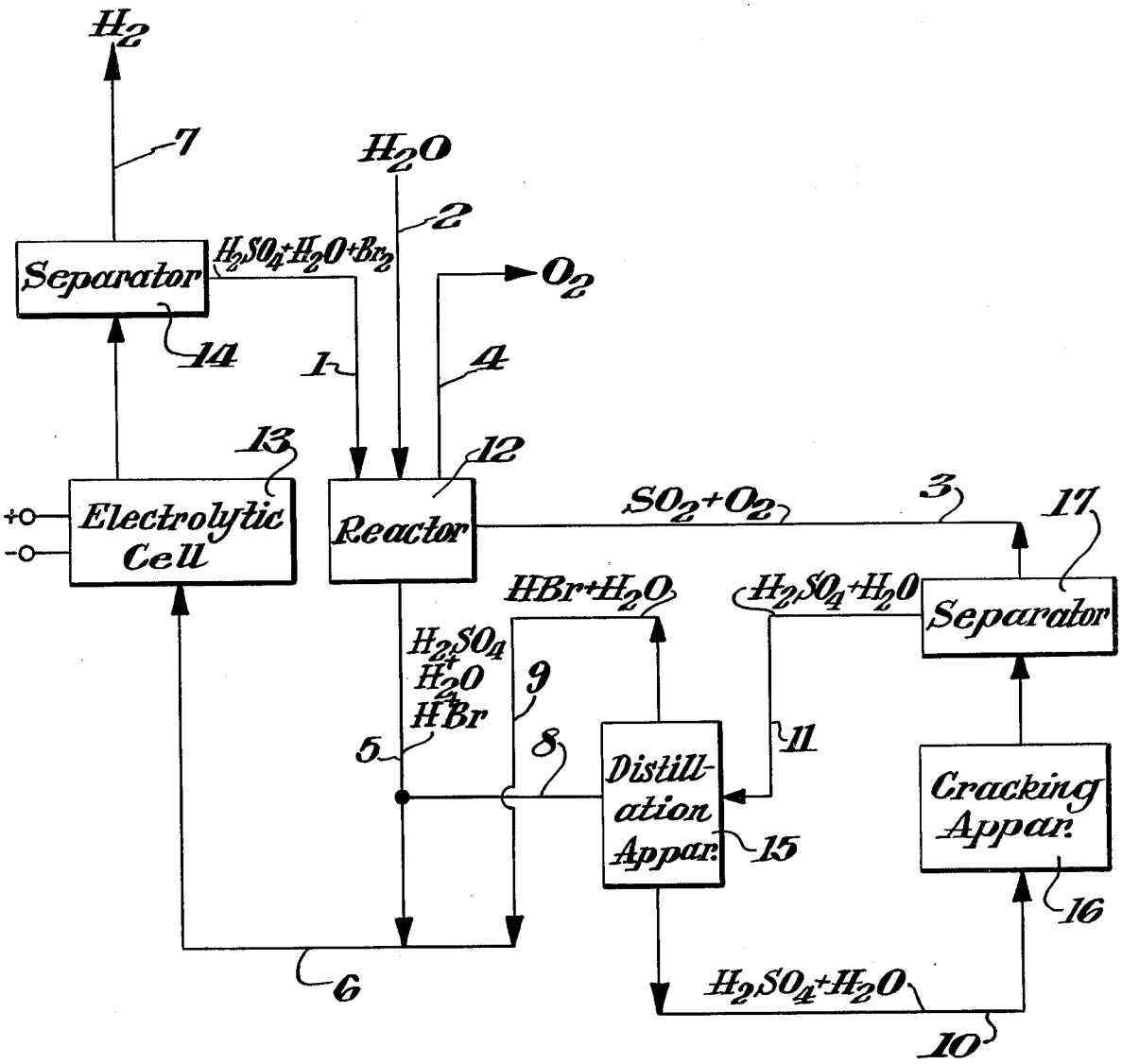
$H_2$
7
$H_2O$
2
Separator
$H_2SO_4+H_2O+Br_2$
$O_2$
14
1
4
13
12
Electrolytic Cell
Reactor
$SO_2+O_2$
3
17
$HBr+H_2O$
$H_2SO_4+H_2O$
Separator
$H_2SO_4$
$H_2O$
HBr
9
5
8
11
Distill-ation Appar.
15
Cracking Appar.
16
6
$H_2SO_4+H_2O$
10

THERMOELECTROCHEMICAL CYCLICAL PROCESS FOR PRODUCTION OF HYDROGEN AND OXYGEN FROM WATER

There has been described a plurality of multi-step circulation processes, wherein, using iron compounds and halogen and hydrogen halide, for example, as the auxiliary agents, water is converted into hydrogen and oxygen. Disadvantageous in this process is particularly the relatively great number of process steps, generally four to five, as well as the large quantities of solids, which must be transported from step to step. On the other hand, known for a long time has been the electrolysis of water, which can be carried out, however, only with a relatively poor efficiency. It has furthermore been suggested to combine an electrolytic reaction with a thermochemical one in order to decompose water to hydrogen and oxygen. Such a combination offers advantages then when it contains an electrolysis with the least possible decomposition voltage and overvoltage as well as a thermochemical conversion, wherein the heat of a high temperature level may be utilized, such as that produced in a high-temperature nuclear reactor, for example.

The object of the invention is to provide an improved process for the decomposition of water into hydrogen and oxygen. The solution of this problem occurs, according to the invention, by means of a multi-step thermoelectrochemical circulation process for the obtainment of hydrogen and oxygen from water in such a manner that in a first process step, water and sulfur dioxide are reacted in aqueous sulfuric acid containing bromine with the formation of sulfuric acid and hydrogen bromide; a partial flow is drawn from the obtained reaction mixture, which corresponds to the sulfuric acid newly formed by the reaction of sulfur dioxide. The hydrogen bromide, existing in the remaining circulated solution of sulfuric acid, is decomposed in an electrolytic cell into bromine and hydrogen and the hydrogen is removed from the process. The remaining bromine-containing sulfuric acid is recycled into the first process step. After separation of the hydrogen bromide contained in the drawn-off partial flow, the sulfuric acid remaining therein is cracked into water, sulfur dioxide and oxygen; the separated hydrogen bromide as well as the water are conducted into the circulation flow; the mixture of sulfur dioxide and oxygen is conducted into the first process step, wherein the sulfur dioxide is reacted and the thus-released oxygen is removed from the process.

In the first process step, sulfur dioxide is conducted into the bromine-containing aqueous sulfuric acid. At the same time, there is added a quantity of water corresponding to this sulfur dioxide. The reaction is advantageously undertaken at an elevated temperature, e.g., 30°-60° C, and, if desired, also under elevated pressure of up to about 50 atmospheres. The reaction is conducted in such a manner that the reaction mixture leaving the first process step contains about 50-90% sulfuric acid and 1-5%, preferably 2-4%, hydrogen bromide. From the solution containing the thus-obtained hydrogen bromide, a partial flow of 10-20%, for example, is removed for sulfuric acid cracking, while the remaining flow is circulated through an electrolytic cell. The electrolysis of the hydrogen bromide-containing aqueous sulfuric acid can occur in customary apparatus and in a customary manner.

It is advantageous to work at elevated temperatures, e.g., 60°-100° C; optionally also under elevated pressure, for example up to 50 bar. In so doing, one can work with a cell divided by a membrane, for example a cation exchange membrane, or a diaphragm, but also with an undivided cell. Optionally, an intermixing of the anolyte may be suitable. One can work with customary electrodes such as platinum, platinum-plated titanium or glass graphite, for example, selecting in such an instance current densities of about 2-20 amperes/dm$^2$. The hydrogen drawn from the cell is suitable freed of carry-over bromine and hydrogen bromide, for example by a wash.

For the working up of the withdrawn partial flow, first the hydrogen bromide as well as a portion of the water are separated by distillation at temperatures of up to 220° C, for example, in a customary manner, and these products are reconveyed into the electrolytic circulation. Subsequently, the sulfuric acid is cracked into water, sulfur dioxide and oxygen. The cracking of sulfuric acid can take place thermally, e.g. at temperatures of 700°-1000° C, or also catalytically with the use of known catalysts, e.g. vanadium oxides. The heat required here can advantageously be removed from the coolant of a high-temperature nuclear reactor. The water obtained in sulfuric acid cracking can optionally be separated with residual sulfuric acid and into the prior step involving distillation of hydrogen bromide. The mixture of sulfur dioxide and oxygen is conducted into the first process step. The sulfur dioxide reacts here, as described above, with bromine and water, while the oxygen, thus freed of sulfur dioxide, is withdrawn from the process step. It, too, is suitably freed of the carry-over bromine and hydrogen bromide, for example by a wash, prior to removal from the process. By the transfer of the separation from sulfur dioxide of the oxygen obtained from sulfuric acid into the first process step, the otherwise difficult problem of working up the gas mixture from the sulfuric acid cracking is greatly simplified and the economy of the process considerably increased.

The drawing illustrates a flow chart, in simplified form, for one embodiment of the novel process.

In reactor 12 the mixture of sulfuric acid, water and bromine, originating in electrolytic cell 13, is introduced through conduit 1 with water through conduit 2 and a mixture of sulfur dioxide and oxygen through conduit 3. In 12 there occurs, at about 50° C and 10 atmospheres, the conversion of bromine and sulfur dioxide with water to hydrogen bromide and sulfuric acid. The oxygen separated therein is removed from the process through conduit 4. The reaction mixture of about 70% sulfuric acid, about 3% hydrogen bromide and the rest water is removed from reactor 12 through conduit 5 and to a preponderant extent conducted through conduit 6 to the undivided electrolytic cell 13. Here occurs the electrolysis of hydrogen bromide into bromine and hydrogen. Hydrogen is separated in separator 14 from the mixture leaving the electrolysis and removed from the process through conduit 7. The mixture freed of hydrogen reaches reactor 12 through conduit 1. Through conduit 8, a partial flow is introduced into the distillation apparatus 15 from reactor 12. The quantity of this partial flow is adjusted in such a manner that sulfuric acid existing therein corresponds to the quantity of sulfuric acid formed in reactor 12 from the water and sulfur dioxide introduced therein through conduits 2 and 3 respectively. The hydrogen bromide as well as the greatest portion of water is removed at about 200° C in distillation apparatus 15. Both distillates are conveyed through conduit 9 to the electrolytic circulation. The remaining concentrated sulfuric acid reaches the cracking apparatus 16 through conduit 10. Here, at about 800° C, the sulfuric acid is cracked into water, sulfur dioxide and oxygen in the presence of a $V_2O_5$ catalyst. The product mixture resulting from cracking is quickly cooled to about 80° C. In separator 17 the water together with the unsplit sulfuric acid is separated from the mixture of cracking products and is conducted through conduit 11 into distillation apparatus 15. The remaining gas mixture of sulfur dioxide and oxygen reaches reactor 12 through conduit 3. The basis for percentage expressions is by weight.

We claim:

1. A process for producing hydrogen and oxygen by a multi-step thermoelectrochemical cyclical process comprising the steps a. reacting water and sulfur dioxide in aqueous sulfuric acid containing 1–5% bromine at 30°–60° C to form an aqueous solution of about 50–90% sulfuric acid and hydrogen bromide;

b. removing from the reaction mixture obtained in step (a), a partial flow of 10–20% of said mixture which corresponds to the sulfuric acid formed from the sulfur dioxide in step (a);

c. electrolytically decomposing the hydrogen bromide in the remaining portion of the reaction mixture obtained in step (a) into bromine and hydrogen in an electrolytic cell at 60°–100° C;

d. removing the hydrogen from the process and recycling the bromine-containing sulfuric acid from the electrolytic cell back into step (a);

e. separating hydrogen bromide from the sulfuric acid in the partial flow withdrawn in step (b) and cracking the remaining sulfuric acid into water, sulfur dioxide and oxygen;

f. recycling the separated hydrogen bromide and water into the electrolytic cell;

g. introducing the mixture of sulfur dioxide and oxygen into process step (a) and thereafter removing the oxygen.

2. The process of claim 1 wherein sulfur dioxide, water and bromine in step (a) react under an elevated pressure of up to 50 atmospheres.

3. The process of claim 1 wherein the hydrogen bromide content of the mixture entering the electrolytic cell of step (c) is 1 – 5%.

4. The process of claim 1 wherein the electrolysis of step (c) is conducted at an elevated pressure of up to 50 bar.

5. The process of claim 1 wherein the current density in the electrolysis of step (c) is about 2–20 amperes/$dm^2$.

6. The process of claim 1 wherein the sulfuric acid of step (e) is cracked at 700° – 1000° C.

7. The process of claim 1 wherein the sulfuric acid of step (e) is cracked in the presence of $V_2O_5$.

* * * * *